US009976823B1

(12) United States Patent
Pike et al.

(10) Patent No.: US 9,976,823 B1
(45) Date of Patent: May 22, 2018

(54) SELF-RELEASING LATCH FOR A FIREARM CHARGING HANDLE

(71) Applicants: Mark W. Pike, Fayetteville, NC (US); Jaime L. Villamil, Fayetteville, NC (US)

(72) Inventors: Mark W. Pike, Fayetteville, NC (US); Jaime L. Villamil, Fayetteville, NC (US)

( * ) Notice: Subject to any disclaimer, the term of this patent is extended or adjusted under 35 U.S.C. 154(b) by 0 days. days.

(21) Appl. No.: 15/399,720

(22) Filed: Jan. 5, 2017

(51) Int. Cl.
*F41A 3/72* (2006.01)
*F41A 35/06* (2006.01)
*F41A 3/66* (2006.01)

(52) U.S. Cl.
CPC *F41A 3/72* (2013.01); *F41A 3/66* (2013.01); *F41A 35/06* (2013.01)

(58) Field of Classification Search
CPC ..... F41A 3/72; F41A 7/02
USPC ..... 89/1.4
See application file for complete search history.

(56) References Cited

U.S. PATENT DOCUMENTS 3,362,292 A * 1/1968 D'Andrea ..... F41A 5/32 89/164
8,266,998 B1 * 9/2012 Davis ..... F41A 3/72 42/71.01
8,381,628 B1 * 2/2013 Wheatley ..... F41A 3/72 42/43
2011/0005372 A1 * 1/2011 Kincel ..... F41A 3/72 89/1.4
2014/0020549 A1 * 1/2014 Bayly ..... F41A 3/72 89/1.4
2014/0318356 A1 * 10/2014 Cupps ..... F41A 3/72 89/1.4
2016/0178298 A1 * 6/2016 Daniel ..... F41A 3/72 89/1.4
2016/0258698 A1 * 9/2016 Seuk ..... F41A 35/06

* cited by examiner

*Primary Examiner* — Bret Hayes

(57) ABSTRACT

A self-releasing latch for a firearm charging handle is disclosed. The charging handle self-releasing latch includes a roller arm and a roller wheel. The roller arm includes a roller wheel at one end and a protrusion at the other end for engaging a spring. Further, a rocker feature provides a pivot point about midway of the roller arm. The roller wheel of the self-releasing latch engages with a detent or groove under spring force to hold the charging handle in the latched state. Aspects of the charging handle self-releasing latch are that it allows substantially frictionless operation of the charging handle without any manual actuation of levers and/or latches, and that it allows ambidextrous operation of the charging handle of an AR-style weapon platform. Further, a method is provided of retrofitting an existing firearm with the presently disclosed charging handle self-releasing latch.

8 Claims, 10 Drawing Sheets

DETAIL A
SCALE 2 : 1

SELF-RELEASING LATCH FOR A FIREARM CHARGING HANDLE

TECHNICAL FIELD

The presently disclosed subject matter relates generally to firearm charging handles and more particularly to a self-releasing latch for a firearm charging handle.

BACKGROUND

Many firearms incorporate some manner of charging handle, sometimes also referred to as a cocking handle or bolt handle, allowing a user of the firearm to manually draw a bolt of the firearm to the rear. This can serve various purposes depending on the firearm. For instance, in automatic and semi-automatic rifles, in which the firing mechanism automatically cycles the bolt under ordinary circumstances, it may be necessary to use the charging handle to clear the firearm after a misfire.

In the AR weapon platform the charging handle typically enters the receiver via an opening on the rear end thereof above where the buffer tube and buttstock extends rearwardly. The typical charging handle for such rifles includes a shaft that is inserted through the opening in the receiver and with a front end engaging the bolt and an operator portion at a rear end of the bolt engagement portion that is adapted to be grasped by the user and incorporates a latch.

Currently, Standard/Milspec charging handle designs are limited because they are not designed for latchless or ambidextrous use. Consequently, the U.S. military is currently searching for a simple, lightweight, and low cost solution to the ambidextrous charging handle problem. Current attempts to making ambidextrous charging handles have been less than satisfactory (e.g., cause excessive receiver wear, too complex, too heavy).

SUMMARY

A self-releasing latch for a firearm charging handle is provided, wherein the self-releasing latch comprises a roller mechanism configured to:

engage with a detent or groove in a firearm under spring force to hold the charging handle in a latched state; and disengage with the detent or groove in the firearm when a rearward pulling force capable of overcoming the spring force is applied to the charging handle, wherein the roller mechanism disengages by rolling over the edge of the detent or groove.

In some embodiments, the roller mechanism comprises a roller arm and a roller wheel. In further embodiments, the roller arm comprises a roller end and a spring force end. In further embodiments, the roller end comprises a fork configured to receive the roller wheel. In further embodiments, the roller wheel is held in the fork with a pivot pin. In further embodiments, a protrusion is provided at the spring force end of the roller arm, wherein the protrusion is configured to engage with a spring in the charging handle.

In further embodiments, a rocker feature is provided along the roller arm, wherein the rocker feature comprises a through hole, and further wherein the through hole is a pivot point of the self-releasing latch and is configured to allow pinning the self-releasing latch to the charging handle. In further embodiments, the fork, the protrusion, and the rocker feature are oriented in the same direction off of the roller arm.

In further embodiments, the firearm comprises an upper-receiver portion, and wherein the upper receiver portion comprises the detent or groove in the firearm. In further embodiments, the detent or groove is a receiver latch groove. In further embodiments, the firearm is an AR ("Armalite ride")-style weapon platform. In further embodiments, the AR-style weapon platform includes rifles or pistols comprising an AR system (e.g., A1, A2, mil-spec carbine, or commercial carbine). Such firearms include, but are not limited to, AR-10 rifles, AR-15 rifles, M4 rifles, and M16 rifles. The firearms can be semi-automatic or fully automatic weapons.

A method is also provided for retrofitting a AR-style weapon platform with a self-releasing latch as described herein, the method comprising the steps of:

a) providing a AR-style weapon platform comprising an existing charging handle, wherein the existing charging handle comprises an existing charging handle latch;

b) removing the existing charging handle from the AR-style weapon platform via the existing charging handle latch;

c) removing the existing charging handle latch from the existing charging handle;

d) installing the self-releasing latch in the existing charging handle, thereby producing a firearm charging handle comprising a self-releasing latch; and e) inserting the firearm charging handle comprising the self-releasing latch into the AR-style weapon platform.

In further embodiments, step (d) comprises:

i) positioning the roller arm of the self-releasing latch such that the protrusion is engaged with the spring and the through hole in the rocker feature is aligned with an existing hole for receiving the pivot pin; and ii) inserting the pivot pin into the through hole in the roller arm of the self-releasing latch and press-fitting the pivot pin into an existing hole in the existing charging handle.

BRIEF DESCRIPTION OF THE DRAWINGS

Figure 1:
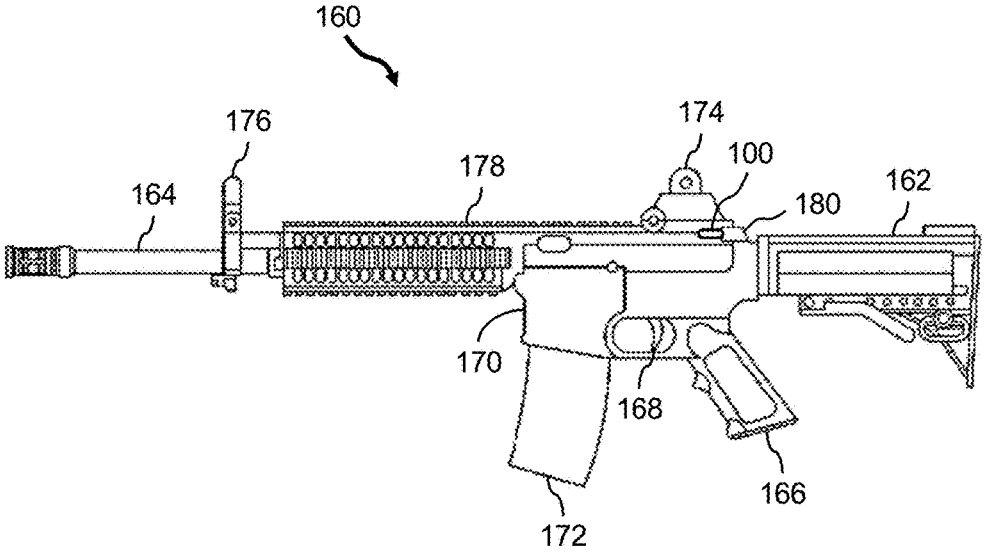
Figure 2:
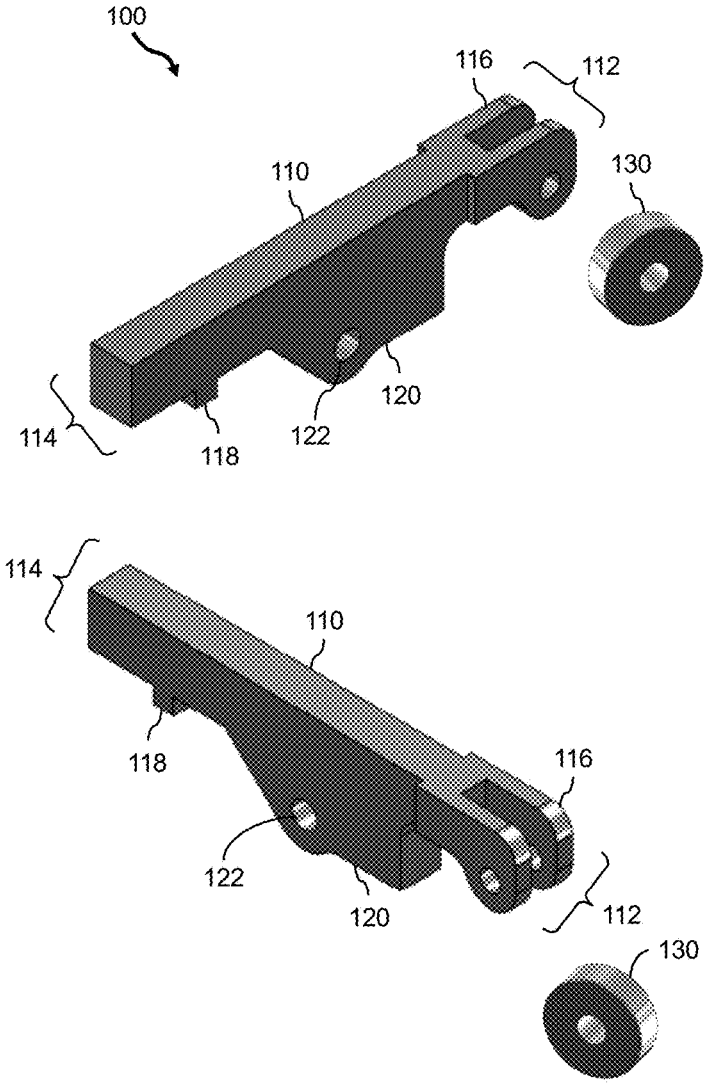
Figure 3:
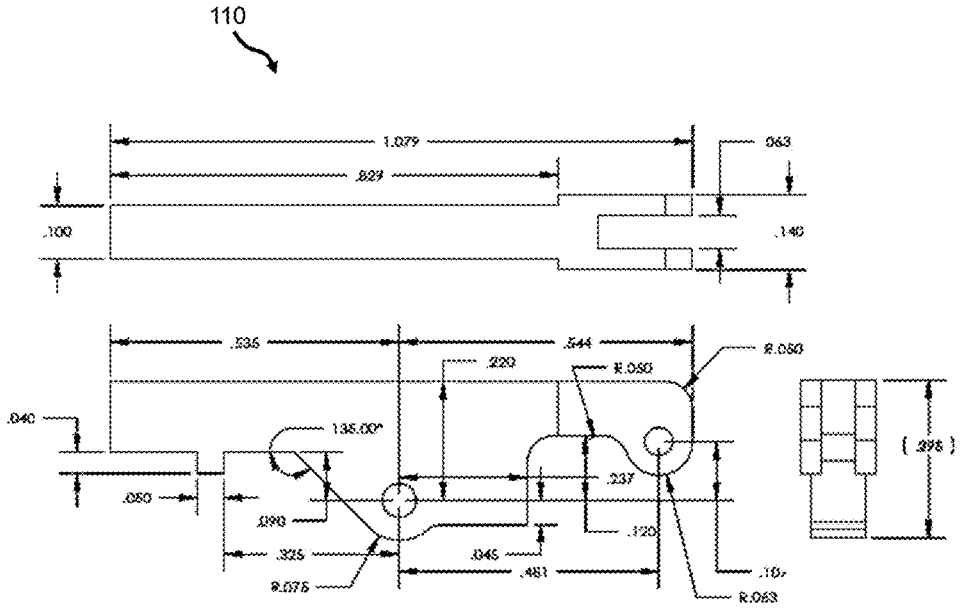
Figure 4:
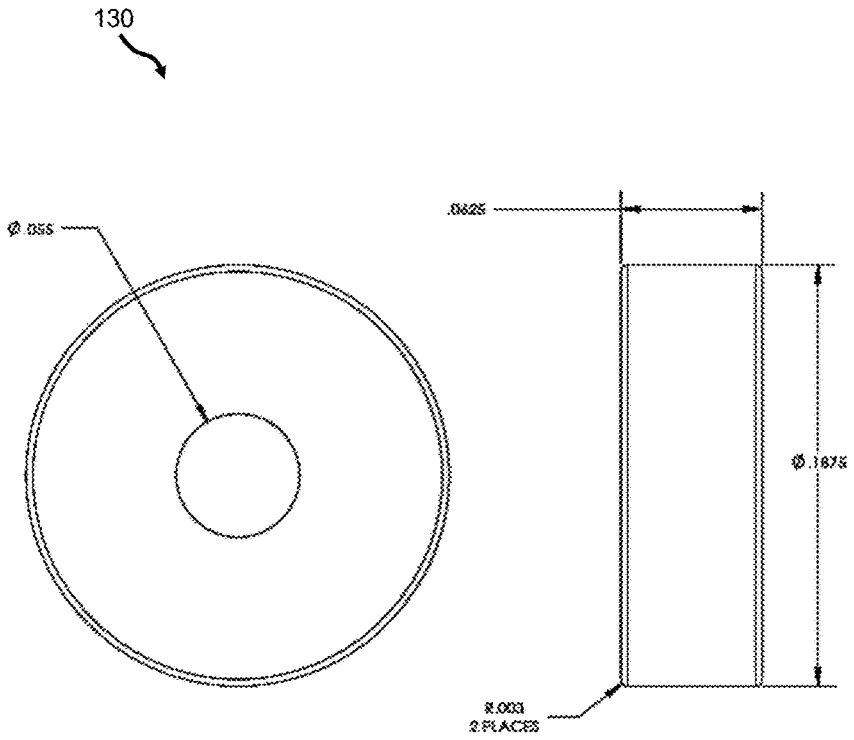
Figure 5:
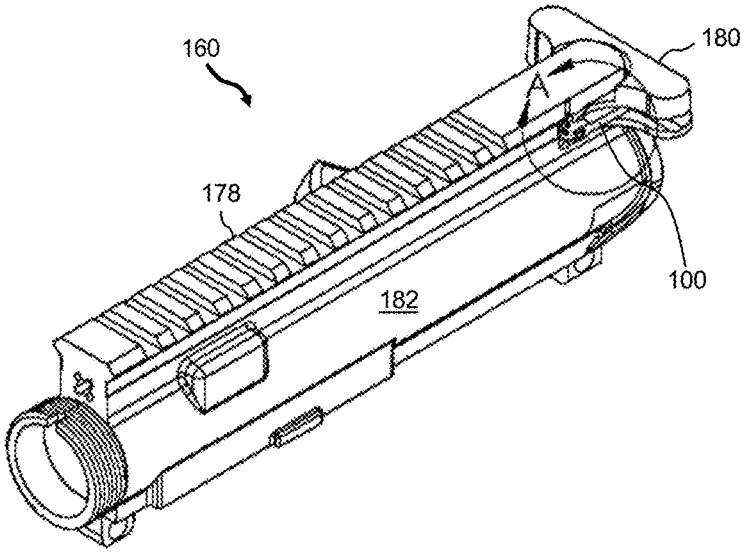
Figure 6:
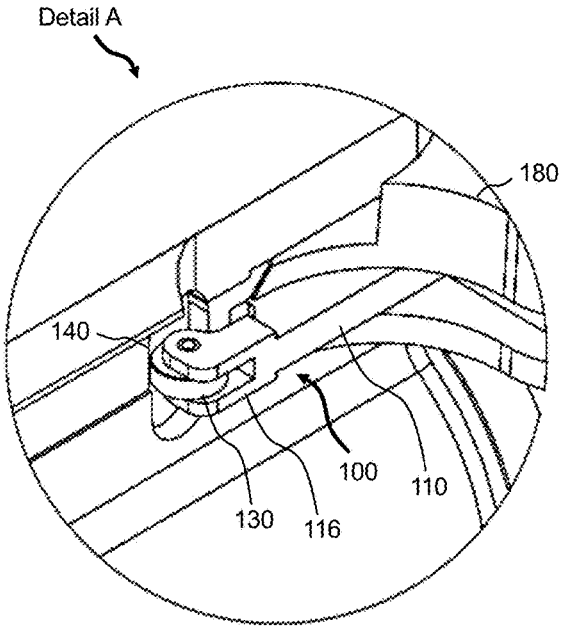
Figure 7A:
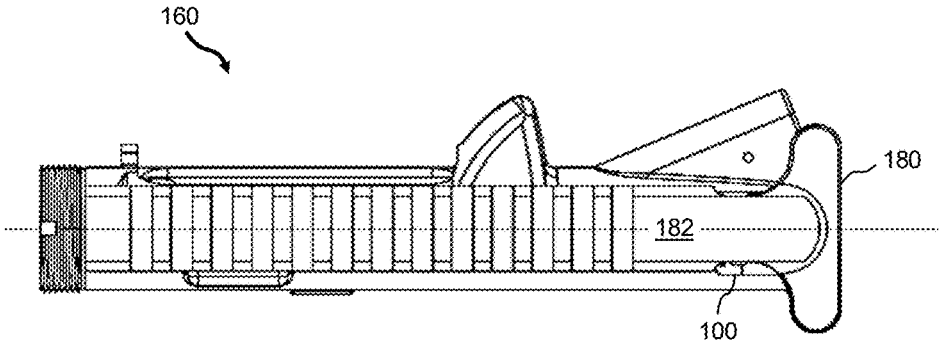
Figure 7B:
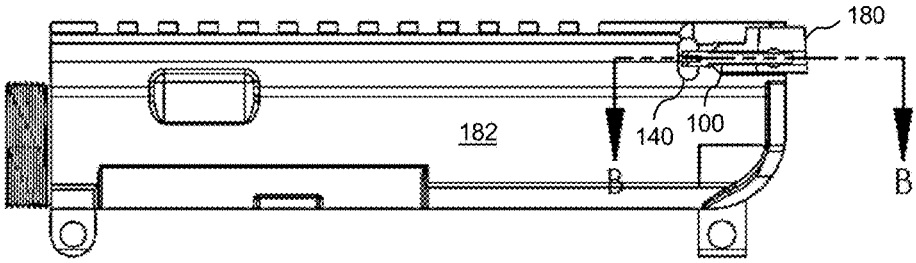
Figure 8:
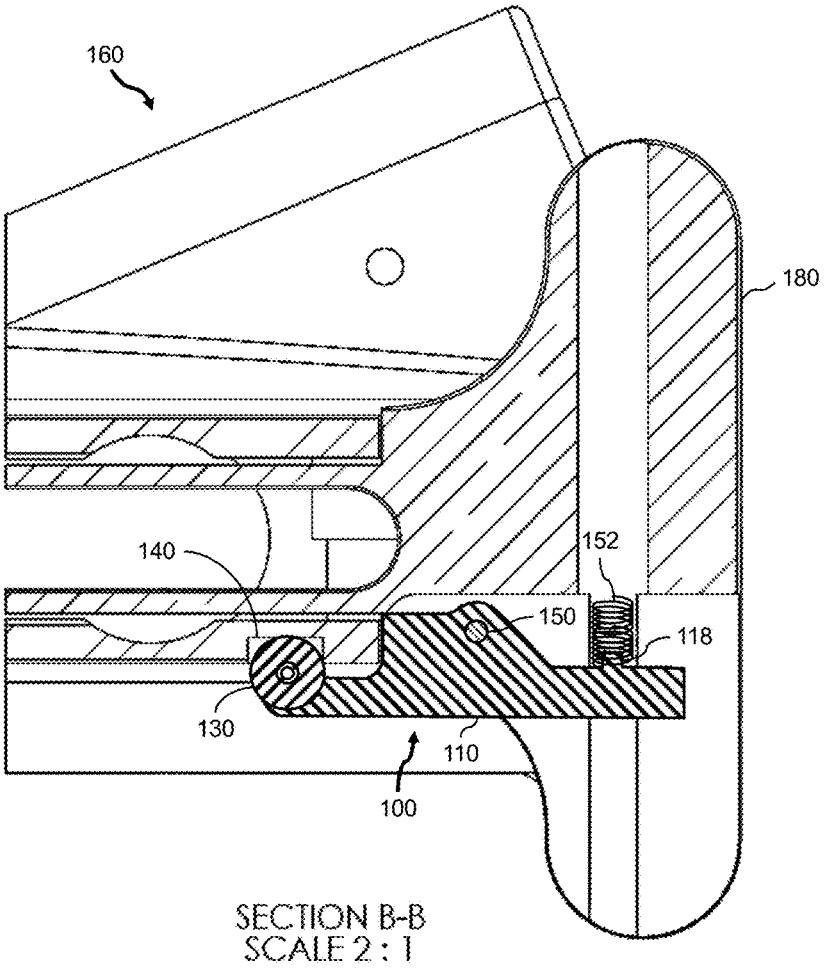
Figure 9:
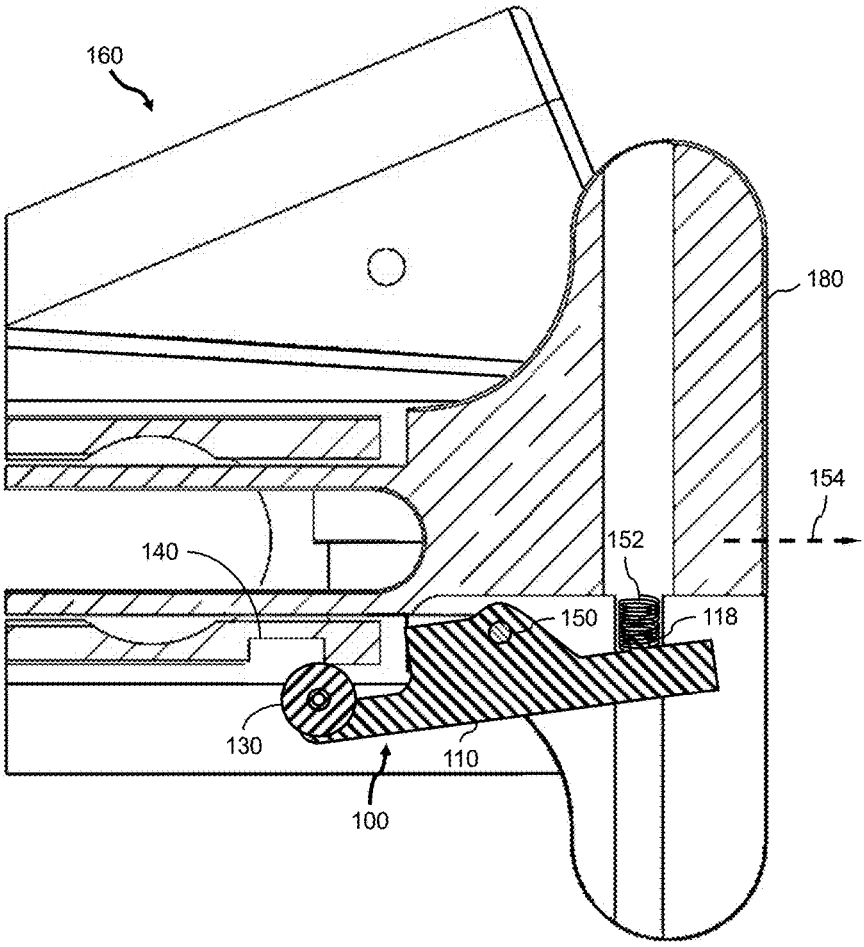
Figure 10:
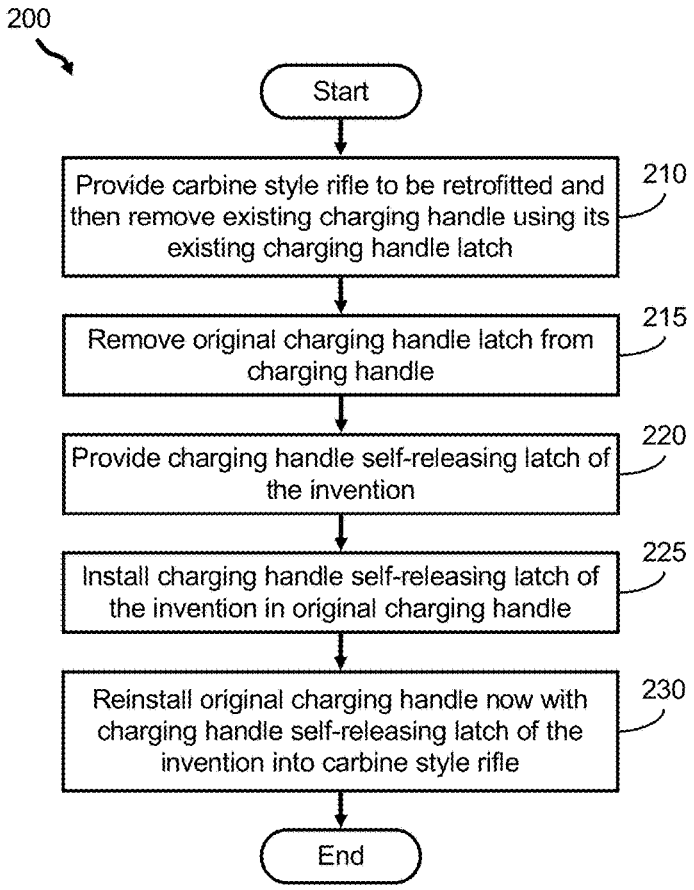

Having thus described the presently disclosed subject matter in general terms, reference will now be made to the accompanying Drawings, which are not necessarily drawn to scale, and wherein:

FIG. 1 illustrates a side view of an example of the presently disclosed charging handle self-releasing latch in relation to a AR-style weapon platform;

FIG. 2 illustrates perspective views of the presently disclosed charging handle self-releasing latch and showing more details thereof;

FIG. 3 illustrates a top view, a side view, and an end view of an example of a roller arm of the presently disclosed charging handle self-releasing latch;

FIG. 4 illustrates a side view and an end view of an example of a roller wheel of the presently disclosed charging handle self-releasing latch;

FIG. 5 illustrates a perspective view of the upper receiver-portion of the AR-style weapon platform and showing the presently disclosed charging handle self-releasing latch;

FIG. 6 shows a Detail A of the charging handle shown in FIG. 5, which is a magnified view of the presently disclosed charging handle self-releasing latch;

FIG. 7A and FIG. 7B illustrate a top view and side view, respectively, of the upper receiver-portion of the AR-style weapon platform and showing the presently disclosed charging handle self-releasing latch;

FIG. 8 and FIG. 9 illustrate cross-sectional views of the presently disclosed charging handle self-releasing latch taken along line B-B for FIG. 7B and showing the self-releasing latch in the latched and unlatched state, respectively; and FIG. 10 illustrates a flow diagram of an example of a method of retrofitting a AR-style weapon platform with the presently disclosed charging handle self-releasing latch.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a self-releasing latch for a firearm charging handle. Namely, the charging handle self-releasing latch includes a roller mechanism that can be engaged with a detent or groove under spring force to hold the charging handle in the latched state. To unlatch the charging handle, a user simply applies a rearward pulling force to the charging handle, wherein the pulling force overcomes the spring force that is holding the roller mechanism of the self-releasing latch into the detent or groove and the charging handle is released. Further, a method is provided of retrofitting an existing firearm with the presently disclosed charging handle self-releasing latch.

An aspect of the presently disclosed charging handle self-releasing latch is that it allows substantially frictionless operation of the charging handle without any manual actuation of levers and/or latches.

Another aspect of the presently disclosed charging handle self-releasing latch is that it allows ambidextrous operation of the charging handle of an AR-style weapon platform.

Yet another aspect of the presently disclosed charging handle self-releasing latch is that it provides an ambidextrous latching mechanism that is simple, lightweight, low cost, and reliable.

Still another aspect of the presently disclosed charging handle self-releasing latch is that it provides an ambidextrous latching mechanism that can be easily retrofitted into existing firearms. In some aspects, the firearm is an AR ("Armalite rifle")-style weapon platform. In other aspects, the AR-style weapon platform includes rifles or pistols comprising an AR system (e.g., A1, A2, mil-spec carbine, or commercial carbine). Such firearms include, but are not limited to, AR-10 rifles, AR-15 rifles, M4 rifles, and M16 rifles. The firearms can be semi-automatic or fully automatic weapons.

Referring now to FIG. 1 is a side view of an example of the presently disclosed charging handle self-releasing latch 100 in relation to a AR-style weapon platform 160. The AR-style weapon platform 160 can be, for example, any conventional AR-15 rifle. The components of the AR-style weapon platform 160 include, but are not limited to, a stock 162, a barrel 164, a pistol grip 166, a trigger 168, a magazine well 170, a magazine or clip 172, a rear site 174, a front site 176, an accessory mount system 178; all of which are well known and conventional. The accessory mount system 178 can be any standard mounting platform for accessories and attachments, such as the Picatinny rail, the Weaver rail mount, and the KeyMod system. Examples of accessories and attachments include lights, lasers, and grips.

Further, a charging handle 180 is in the upper receiver portion of the AR-style weapon platform 160. The charging handle, also known as cocking handle or bolt handle, is a device on a firearm which, when operated, results in the hammer or striker being cocked or moved to the ready position. The charging handle allows the operator to pull the bolt to the rear. The charging handle has a number of functions: (1) it facilitates the ejection of a spent shell casing or unfired round from the chamber; (2) it loads a round from the magazine or by hand through the chamber; (3) it clears a stoppage such as a jam, double feed, or misfire; (4) it verifies that the weapon's chamber is clear of any rounds or other obstructions; and (5) it moves the bolt in to battery and (6) it can be used to release a bolt locked to the rear, such as would be the case after firing the last round and the bolt locks in the open position.

The presently disclosed self-releasing latch 100 is integrated into the charging handle 180. The self-releasing latch 100 provides a roller mechanism that can be engaged with a detent or groove (see FIG. 8 and FIG. 9) under spring force to hold the charging handle 180 in the latched state. To unlatch the charging handle 180, a user simply applies a pulling force to the charging handle 180, wherein the pulling force overcomes the spring force that is holding the roller mechanism of the self-releasing latch 100 into the detent or groove and the charging handle 180 is released. As described further below, when the pulling force overcomes the spring force, the roller wheel disengages from the detent by rolling up over the edge of the detent, which allows the charging handle 180 to be released. By rolling up over the edge of the detent, friction is significantly reduced and receiver wear is reduced or substantially eliminated. Because of the self-releasing latch 100, no manual manipulation of levers and/or latches is required to release the charging handle 180. More details of the self-releasing latch 100 are shown and described hereinbelow with reference to FIG. 2 through FIG. 10.

Referring now to FIG. 2, perspective views of the presently disclosed charging handle self-releasing latch 100 are provided showing more details of the self-releasing roller mechanism. The self-releasing latch 100 includes a roller arm 110 and a roller wheel 130. The roller arm 110 includes a roller end 112 and a spring force end 114. A fork 116 is provided at the roller end 112 of the roller arm 110, wherein the fork 116 is designed to receive the roller wheel 130 (see FIG. 6). The roller wheel 130 can be held in the fork 116 with a pivot pin (not shown). A protrusion 118 is provided at the spring force end 114 of the roller arm 110, wherein the protrusion 118 is designed to engage with a spring 152 (see FIG. 8 and FIG. 9) in the charging handle. A rocker feature 120 is provided about midway of the roller arm 110. The rocker feature 120 includes a through hole 122, which is the pivot point of self-releasing latch 100 when installed in the charging handle. Namely, using through hole 122, the self-releasing latch 100 can be pinned (see FIG. 8 and FIG. 9) to the charging handle. The fork 116, the protrusion 118, and the rocker feature 120 are oriented in the same direction off of the roller arm 110.

Referring now to FIG. 3 is a top view, a side view, and an end view of an example of the roller arm 110 of the presently disclosed self-releasing latch 100. The dimensions shown in FIG. 3 are in inches.

Referring now to FIG. 4 is a side view and an end view of an example of the roller wheel 130 of the presently disclosed self-releasing latch 100. The dimensions shown in FIG. 4 are in inches.

Referring now to FIG. 5 is a perspective view of the upper receiver-portion of the AR-style weapon platform 160 and showing the presently disclosed self-releasing latch 100 in relation to the charging handle 180. Further, FIG. 6 shows a Detail A of the charging handle shown in FIG. 5, which is a magnified view of the presently disclosed charging handle self-releasing latch 100. Detail A shows the roller end 112 of the roller arm 110 only. In Detail A, the spring force end 114 and rocker feature 120 of the roller arm 110 are hidden from view inside the charging handle 180. Detail A shows the roller wheel 130 installed in the fork 116 of the roller arm 110 of the self-releasing latch 100. Detail A also shows the roller wheel 130 engaged with an existing detent 140 in the upper receiver-portion of the AR-style weapon platform 160. Namely, the detent 140 is an existing receiver latch groove in the upper receiver-portion of the AR-style weapon platform 160.

Referring now to FIG. 7A and FIG. 7B is a top view and side view, respectively, of the upper receiver-portion of the AR-style weapon platform 160 and showing the presently disclosed self-releasing latch 100.

FIG. 8 and FIG. 9 show the operation of the presently disclosed charging handle self-releasing latch 100, wherein FIG. 8 and FIG. 9 are cross-sectional views of the presently disclosed self-releasing latch 100 taken along line B-B for FIG. 7B. For example, FIG. 8 shows the self-releasing latch 100 in the latched position, wherein the roller wheel 130 is engaged with the detent 140 under spring force to hold the charging handle 180 in the latched state. For example, FIG. 8 shows the roller arm 110 of the self-releasing latch 100 pivotably installed in the charging handle 180 via a pivot pin 150 and with the protrusion 118 engaged with a spring 152 in the charging handle 180. With the charging handle 180 pushed fully forward into the upper receiver-portion of the AR-style weapon platform 160, the roller wheel 130 is fully engaged with the detent 140 and held under spring force via the spring 152.

To release the charging handle 180, FIG. 9 shows that a rearward force pulling force, such as a pulling force 154, can be applied to the charging handle 180. When the pulling force 154 overcomes the spring force of the spring 152, the roller wheel 130 disengages from the detent 140 by rolling up over the edge of the detent 140, which allows the charging handle 180 to be released. By rolling up over the edge of the detent 140, friction is significantly reduced and receiver wear is reduced or substantially eliminated.

The user can apply the pulling force 154 with any hand from either side of the AR-style weapon platform 160. As a result, the presently disclosed charging handle self-releasing latch 100 provides ambidextrous operation. Further, in the charging handle self-releasing latch 100, no manual actuation of levers and/or latches is required. Using the charging handle self-releasing latch 100, rifle action of the AR-style weapon platform 160 is cycled.

Referring now to FIG. 10 is a flow diagram of an example of a method 200 of retrofitting a AR-style weapon platform with the presently disclosed charging handle self-releasing latch 100. The method 200 may include, but is not limited to, the following steps.

At a step 210, the AR-style weapon platform to be retrofitted (e.g., the AR-style weapon platform 160) is provided and the existing charging handle 180 is removed via its existing charging handle latch as per normal rifle maintenance disassembly.

At a step 215, the existing charging handle latch of the AR-style weapon platform to be retrofitted is removed. For example, the existing charging handle latch can be removed from the charging handle 180 by removing a pin, such as the pivot pin 150 shown in FIG. 8 and FIG. 9, and disengaging the existing charging handle latch from the spring, such as the spring 152 shown in FIG. 8 and FIG. 9.

At a step 220, the charging handle self-releasing latch 100 is provided.

At a step 225, the charging handle self-releasing latch 100 is installed in the existing charging handle 180 of the AR-style weapon platform being retrofitted. For example, the roller arm 110 of the self-releasing latch 100 is positioned such that (1) protrusion 118 is engaged with the spring 152 (see FIG. 8 and FIG. 9) and (2) the through hole 122 in the rocker feature 120 is aligned with the existing hole (not shown) for receiving the pivot pin 150 (see FIG. 8 and FIG. 9). Then, the pivot pin 150 is inserted into the through hole 122 in the roller arm 110 of self-releasing latch 100 and press-fitted into the existing hole (not shown) in the charging handle 180.

At a step 230, the existing charging handle 180 that now includes the self-releasing latch 100 is reinstalled into the AR-style weapon platform being retrofitted (e.g., the AR-style weapon platform 160) as per normal rifle maintenance reassembly.

In summary and referring again to FIG. 1 through FIG. 10, features of the presently disclosed charging handle self-releasing latch 100 include, but are not limited to, the following.

(1) substantially frictionless operation of the charging handle without any manual actuation of levers and/or latches;
(2) ambidextrous operation of the charging handle of an AR-style weapon platform;
(3) an ambidextrous latching mechanism that is simple, lightweight, low cost, and reliable; and
(4) an ambidextrous latching mechanism that can be easily retrofitted into existing firearms.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about"

may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A self-releasing latch for a firearm charging handle, wherein the self-releasing latch comprises a roller mechanism configured to:

engage with a detent or groove in a firearm under spring force to hold the charging handle in a latched state; and disengage with the detent or groove in the firearm when a rearward pulling force capable of overcoming the spring force is applied to the charging handle, wherein the roller mechanism disengages by rolling up over the edge of the detent or groove; and wherein the roller mechanism comprises a roller arm and a roller wheel, wherein:

the roller arm comprises a roller end and a spring force end, wherein the roller end comprises a fork configured to receive the roller wheel and the spring force end comprises a protrusion configured to engage with a spring in the charging handle; and the roller wheel is held in the fork with a pivot pin.

2. The self-releasing latch of claim 1, wherein a rocker feature is provided along the roller arm, wherein the rocker feature comprises a through hole, and further wherein the through hole is a pivot point of the self-releasing latch and is configured to allow pinning the self-releasing latch to the charging handle.

3. The self-releasing latch of claim 2, wherein the fork, the protrusion, and the rocker feature are oriented in the same direction off of the roller arm.

4. The self-releasing latch of claim 3, wherein the firearm comprises an upper-receiver portion, and wherein the upper receiver portion comprises the detent or groove in the firearm.

5. The self-releasing latch of claim 4, wherein the detent or groove is a receiver latch groove.

6. The self-releasing latch of claim 5, wherein the firearm is an AR-style weapon platform.

7. A method of retrofitting an AR-style weapon platform with the self-releasing latch of claim 6, the method comprising the steps of:

a) providing an AR-style weapon platform comprising an existing charging handle, wherein the existing charging handle comprises an existing charging handle latch;

b) removing the existing charging handle from the AR-style weapon platform via the existing charging handle latch;

c) removing the existing charging handle latch from the existing charging handle;

d) installing the self-releasing latch in the existing charging handle, thereby producing a firearm charging handle comprising a self-releasing latch; and e) inserting the firearm charging handle comprising the self-releasing latch into the AR-style weapon platform.

8. The method of claim 7, wherein step (d) comprises:

i) positioning the roller arm of the self-releasing latch such that the protrusion is engaged with the spring and the through hole in the rocker feature is aligned with an existing hole for receiving the pivot pin; and ii) inserting the pivot pin into the through hole in the roller arm of the self-releasing latch and press-fitting the pivot pin into an existing hole in the existing charging handle.

* * * * *